US008701261B2

(12) United States Patent
Crowley

(10) Patent No.: US 8,701,261 B2
(45) Date of Patent: Apr. 22, 2014

(54) AIR HANDLER QUICK SLING

(75) Inventor: William Joseph Crowley, East Freetown, MA (US)

(73) Assignee: Quick-Sling, LLC, Taunton, MA (US)

( * ) Notice: Subject to any disclaimer, the term of this patent is extended or adjusted under 35 U.S.C. 154(b) by 497 days.

(21) Appl. No.: 13/006,316

(22) Filed: Jan. 13, 2011

(65) Prior Publication Data

US 2012/0180288 A1 Jul. 19, 2012

(51) Int. Cl.
*B23P 11/00* (2006.01)
*B23Q 7/00* (2006.01)
*F16M 13/00* (2006.01)

(52) U.S. Cl.
USPC ..... 29/434; 29/559; 248/317; 248/333

(58) Field of Classification Search
USPC ..... 248/317, 333, 323, 327, 214, 320, 340, 248/220.21, 222.14; 29/434, 559
See application file for complete search history.

(56) References Cited

U.S. PATENT DOCUMENTS 1,260,123 A * 3/1918 Areson ..... 248/327
2,729,411 A * 1/1956 Cahill ..... 248/59
5,741,030 A 4/1998 Moore et al.
6,719,247 B1 4/2004 Botting
6,866,579 B2 3/2005 Pilger
7,083,151 B2 8/2006 Rapp
7,261,256 B2 8/2007 Pattie et al.
7,596,962 B2 10/2009 Karamanos
7,793,908 B1 * 9/2010 Finegan, Jr. ..... 248/317
2007/0145222 A1 6/2007 Rausch

* cited by examiner

*Primary Examiner* — Jermie Cozart
(74) *Attorney, Agent, or Firm* — McLane, Graf, Raulerson & Middleton, Professional Association

(57) ABSTRACT

Apparatus for hanging a High Voltage Air Conditioning unit having an arm attached at its top end to a support member, a bar slidably coupled to the arm having a first horizontally extending arm at the bottom of the bar to form a J bar, and a second horizontally extending arm attached to the bottom of the J bar above the first horizontally extending arm. Clearance openings in the arm and J bar for fasteners for attaching the arm to the J bar to raise or lower the horizontally extending arms for units of different heights. Coupling sleeves coupled to the horizontally extending arms and extension member have lengths that provide for HVAC units of different widths and are adapted to be removably attached to coupling sleeves on an opposing J bar. The second horizontally extending arm and extension member provides support an HVAC unit; and the first provides to support a drain pan.

20 Claims, 2 Drawing Sheets

AIR HANDLER QUICK SLING

BACKGROUND OF THE INVENTION

1. Field of the Invention

The present invention relates to building heating, ventilation, and air conditioning ("HVAC") systems and, more particularly relates to an improved apparatus and method for hanging a heating, ventilation and air conditioning unit serving an interior building space.

2. Description of Related Art

Interior spaces of homes and other buildings are typically provided with automatically controlled temperatures using one or more air handling units that provide a recirculating flow of air drawn out of the conditioned space, flows through the air handling unit by an air blower therein, is heated or cooled as necessary within the unit, and then flows back into the conditioned space. Hangers for mounting an HVAC unit in a building are known in the prior art. More specifically, by way of example, U.S. PreGrant Publication No. 2007/0145222 to Rausch discloses a method and device for a hanging device that is used to support ductwork, pipes, wiring, conduit and the like from support beams such as I-Joists.

U.S. Pat. No. 7,596,962 to Karamanos discloses, prior to installation into a HVAC system a fully-functional zone-control unit which also includes a pair of caps which seal the ends of the piping assemblies, and a pressure gauge for sensing pressurization of the piping assemblies and coil which the caps seal. A pressure gauge permits testing to insure that the piping assemblies and coil are leak free.

U.S. Pat. No. 7,261,256 to Pattie, et al. discloses a variable-duct support assembly for mounting a duct. The variable-duct support assembly includes rails having a groove which has a pair of support brackets for supporting a duct. The support brackets are coupled to one or more flexible bands for clamping the duct between the support brackets and the flexible bands.

U.S. Pat. No. 7,083,151 to Rapp discloses a laterally-reinforced duct saddle for hanging a length of horizontal flexible duct from a supporting structure. The duct saddle includes a generally flat, elongated blank adapted for bending around and receiving a portion of the flexible duct.

U.S. Pat. No. 6,866,579 to Pilger discloses a boot hanger mounting bracket assembly formed of a sturdy yet bendable material so that it can be configured and adjusted on-site. Once configured, the boot hanger mounting bracket assembly is secured to the building structure by securing a pair of boot hanger arms to the ceiling joists, wall studs or other support structure to provide a positive inexpensive way to mount the duct components.

U.S. Pat. No. 6,719,247 to Botting discloses a hanger for seating a flexible duct. The hanger has one end that can be attached to a support structure, such as a beam or joist, and a second end with a cradle for receiving as duct that can be freely seated in the cradle.

U.S. Pat. No. 5,741,030 to Moore, et al. discloses an air duct starting collar having integral clips used for installation in a planar surface of an air duct. A flange of the device permits variance in hole size, and roughness of the hole's edge.

SUMMARY OF THE INVENTION

In an exemplary embodiment of the present invention, there is disclosed apparatus for hanging a High Voltage Air Conditioning (HVAC) unit comprising:

at least one arm adapted to be attached at its top end to a steel beam, wood rafter, wood joist or wood beam;

a bar adapted to be slidably coupled to the at least one arm having a first horizontally extending arm located at the bottom of the bar to form a J bar;

a second horizontally extending arm attached to the bottom of the J bar above the first horizontally extending arm;

clearance openings located in the at least one arm and in the J bar for receiving fasteners for attaching the at least one arm to the J bar to raise or lower the first and second horizontally extending arms to provide for HVAC units of different heights;

first and second coupling sleeves coupled to the first and second vertically displaced horizontally extending arms; and first and second extension members removably attached to the first and second coupling sleeves;

wherein the first and second extension members which have lengths that provide for HVAC units of different widths are adapted to be removably attached to first and second coupling sleeves on an opposing J bar;

wherein the second horizontally extending arm and extension member is provided to support an HVAC unit; and wherein the first horizontally extending arm and extension member is provided to support a drain pan.

The more important features of the invention have thus been outlined in order that the more detailed description that follows may be better understood and in order that the present contribution to the art may better be appreciated. Additional features of the invention will be described hereinafter and will form the subject matter of the claims that follow.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The foregoing has outlined, rather broadly, the preferred feature of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention and that such other structures do not depart from the spirit and scope of the invention in its broadest form.

BRIEF DESCRIPTION OF THE DRAWINGS

Other aspects, features, and advantages of the present invention will become more fully apparent from the following detailed description, the appended claim, and the accompanying drawings in which similar elements are given similar reference numerals.

DESCRIPTION OF THE PREFERRED EMBODIMENT

The air handler support unit disclosed is composed of four upper arms adapted to be connected to four "J" shaped bars where each J shaped bar has an upper horizontal extension for receiving an HVAC unit and a lower horizontal extension for receiving an emergency drain pan. The upper arms and the J bars are composed of square metal tubing precut to size and fabricated to shape. The upper arms and the J bars have drilled or punched openings located on centers which are between one and two inches for adjustability. The upper arms are sized to telescope into and out of the J bars to provide for different height adjustments.

Each J bar has two horizontal arms where the upper horizontal arm is used to provide support for an HVAC unit and the lower horizontal arm is used to provide support for an emergency drain pan. Each horizontal arm is sized to telescope into a connecting sleeve and the horizontal arms and connection sleeves have openings for receiving ringed clevis pins or nuts and bolts to lock the two together. Extension members of various lengths are available which telescope into the coupling sleeves for adjusting the width between the left and right J bars to the width of the HVAC unit which is to be supported by the air handler apparatus. The extension members and the coupling sleeves each have openings which are spaced apart by between one and two inches, more or less for receiving ringed clevis pins or nuts and bolts to lock the two together for different dimension applications.

The paddle arms each have at their upper ends a flat plate which is adapted to be located next to a wood support member and has openings which are provided to receive bolts or screws which are used to attach the paddle arm to a wood support member such as a wood rafter, joist or beam.

In an embodiment the flat plate at the upper ends of the paddle arms is adapted to receive at least one C clamps which is used to attach the paddle arms to steel beams.

The air handler apparatus here disclosed telescopes both horizontally and vertically to accommodate units having various heights and widths. The spacing between the front and rear paddle arms is varied to accommodate the length of the HVAC unit. The bottom shelf of the air handler apparatus may be outfitted with two "H" hangers to receive the telescoping emergency drain pan horizontal arm, which can be relocated to the upper shelf to help in removing internal parts of each unit. The entire air handler apparatus disclosed is adjustable to receive HVAC units of different heights, widths and lengths.

Figure 1:
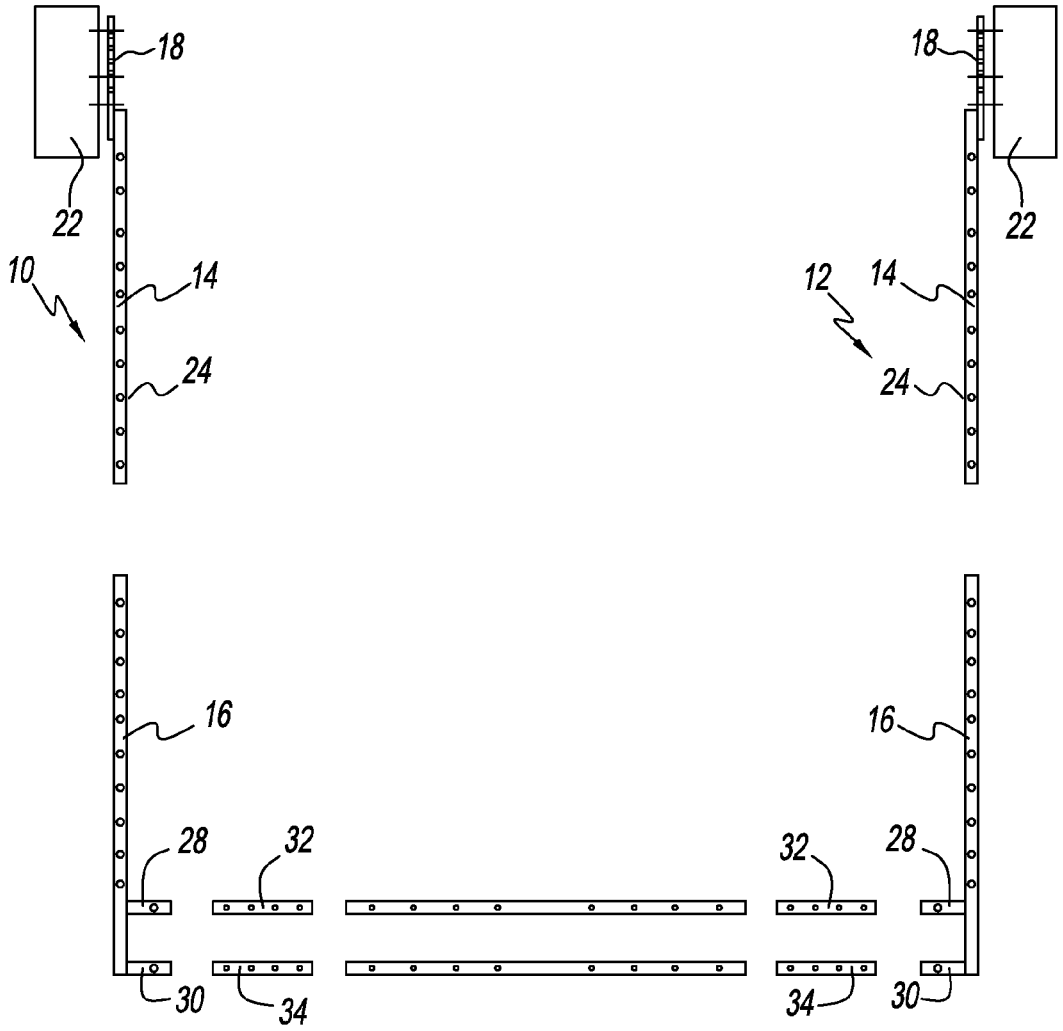
FIG. 1 is a side view of the rear left and rear right hanging arms of the air handler apparatus, the front left and front right hanging arms not being shown, where the hanging arms consists of upper paddle arms attached at their upper ends to separate support members and at their lower ends to a J shaped bar having an upper horizontal extension for receiving a telescoping connecting member for supporting an HVAC unit and a telescoping lower horizontal extension for receiving a telescoping extension for supporting an emergency drain pan.

Referring to FIG. 1, there is disclosed a side view of the rear left hanging arm 10 and rear right hanging arm 12 of the air handler unit, the front left and front right hanging arms not shown, where each hanging arm consists of an upper paddle arm 14 and a "J" bar 16 at its lower end. In the embodiment disclosed each of the hanging arms, the left and right rear hanging arms and the left and right front hanging arms are similar in all aspects and, therefore, the detailed description of the rear left hanging arm which follows applies to each of the other hanging arms.

Upper paddle arm 14 is a square tube composed of steel and having a length of about twenty four inches, more or less. The top of paddle arm 14 is welded to a flat plate 18 having a length of about eight inches, a width of about three inches and a thickness of about one-eighth of an inch, more or less. The flat plate 18 has two columns of openings 20, (see FIG. 2), which are sized for receiving screws or bolts for attaching the paddle arm 14 to a wood support member such as a wood rafter, joist or beam. In the embodiment of FIG. 1 the upper paddle arms are attached to separate wood rafters, joists or rafters.

Paddle arm 14 has a first plurality of openings 24 located on two inch centers which are parallel to the width of the flat plate, and a second plurality of openings 26, (see FIG. 2), located on two inch centers which are transverse to the width of the flat plate and are located between the first plurality of openings 24. Paddle arm 14 which is a square tube composed of steel with an outside dimension of between one-half of an inch and one inch, more or less, telescopes into J bar 16. J bar 16 is a square tube composed of steel with an inside dimension which makes a sliding fit with the outside dimension of paddle arm 14 and has a length of about twenty two and one-half inches, more or less. Located at the bottom of J bar 16 are two horizontally extending arms 28, 30 which are welded to J bar 16 and are vertically displaced from each other by a distance of about five inches, more or less. Each arm 28, 30 is a square tube with a width that is similar to the width of the tube 14, is made of steel, has a length of about two inches, more or less, and telescopes into connecting sleeves 32, 34. J bar 16 and horizontal arms 28, 30 have clearance openings for receiving ringed Clevis pins or nuts and bolts for attaching the J bar 16 to the paddle arm 14 and the arms 28, 30 to connecting sleeves 32, 34. Connecting sleeves 32, 34 each have a length of about fourteen inches, more or less.

Figure 2:
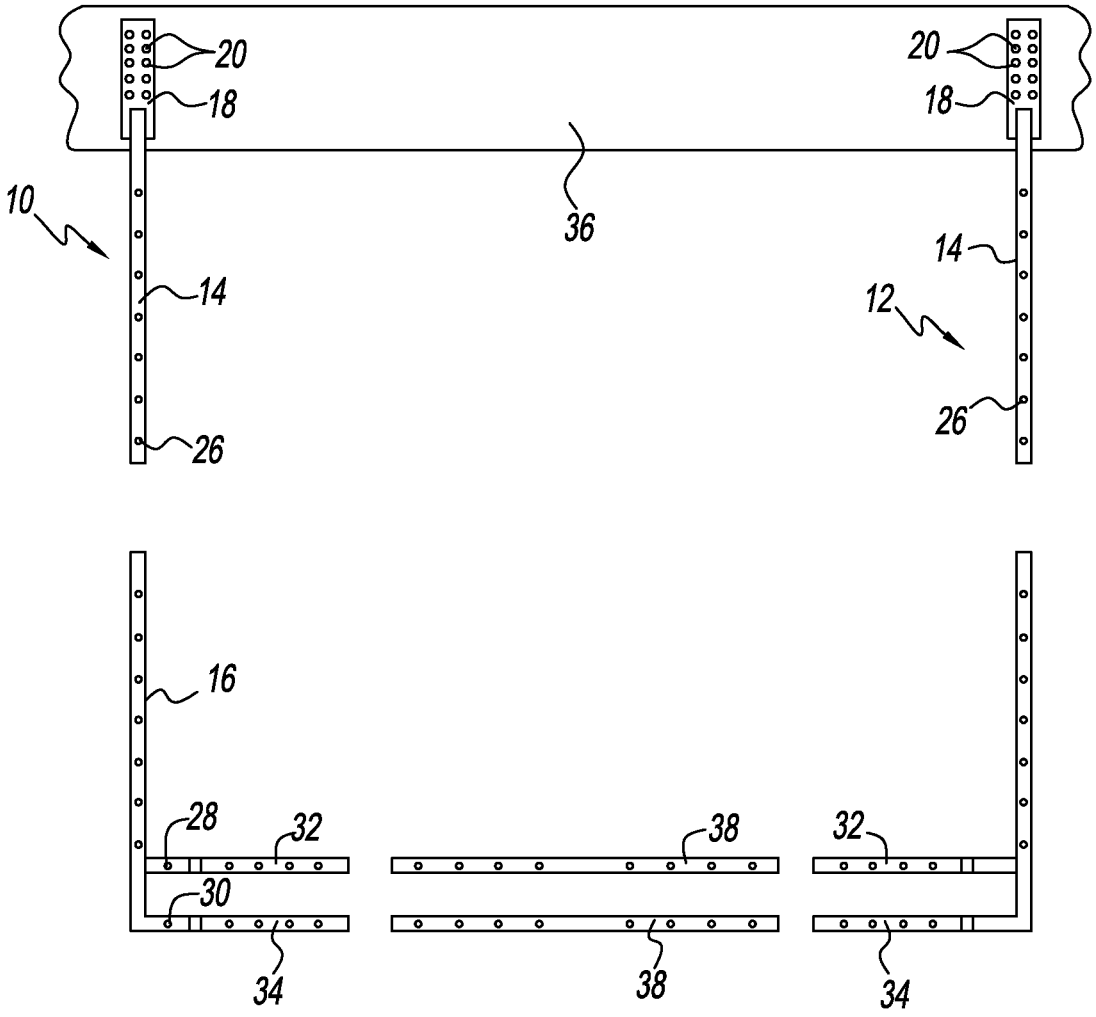
FIG. 2 is a side view of the rear left and rear right hanging arms of the air handler apparatus, the front left and front right hanging arms not being shown, where the hanging arms consists of upper paddle arms which are turned ninety degrees and are attached at their upper ends to a common support member, and at their lower ends to "J" shaped bars having an upper horizontal extension for receiving an AC unit and a lower horizontal extension for receiving an emergency drain pan.

Referring to FIG. 2, there is disclosed a side view of the rear left and rear right hanging arms of the air handler support unit, the front left and front right hanging arms not shown, where the air handler unit of FIG. 2 differs from FIG. 1 only in that the upper paddle arms of the hanging arms are turned ninety degrees and are attached at their upper ends to a common support member rather than to separate support members such as a wood rafter, joist or beam 36 with bolts or screws.

Each J bar telescopes over and is adjustably attached to a paddle arm which allows for different height adjustments from twenty six inches to forty inches in two inch increments. Connecting sleeves 32, 34 on opposing horizontally extending arms 28, 30 of the J bars telescope around horizontal extension members 38 for different width adjustments of between twenty eight inches and forty inches in two inch increments.

While there have been shown and described and pointed out the fundamental novel features of the invention as applied to the preferred embodiments, it will be understood that the foregoing is considered as illustrative only of the principles of the invention and not intended to be exhaustive or to limit the invention to the precise forms disclosed. Obvious modifications or variations are possible in light of the above teachings. The embodiments discussed were chosen and described to provide the best illustration of the principles of the invention and its practical application to enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are entitled.

What is claimed is:

1. Apparatus for hanging a High Voltage Air Conditioning (HVAC) unit comprising:

at least one arm adapted to be attached at its top end to a steel beam, wood rafter, wood joist or wood beam;

a bar adapted to be slidably coupled to the at least one arm having a first horizontally extending arm located at the bottom of the bar to form a J bar;

a second horizontally extending arm attached to the bottom of the J bar above the first horizontally extending arm;

clearance openings located in the at least one arm and in the J bar for receiving fasteners for attaching the at least one arm to the J bar to raise or lower the first and second horizontally extending arms to provide for HVAC units of different heights;

first and second coupling sleeves, the first coupling sleeve telescopically coupled to the first horizontally extending arm and the second coupling sleeve telescopically coupled to the second horizontally extending arm; and first and second extension members, the first extension member telescopically coupled to the first coupling sleeve and the second extension member telescopically coupled to the second coupling sleeve;

wherein the first and second extension members which have lengths that provide for HVAC units of different widths are adapted to be removably and telescopically attached to first and second coupling sleeves on an opposing J bar;

wherein the second horizontally extending arm and extension member are provided to support an HVAC unit; and wherein the first horizontally extending arm and extension member are provided to support a drain pan.

2. The apparatus of claim 1 wherein the at least one arm has a flat plate with clearance openings for receiving bolts or screws to attach the at least one arm to a wood rafter, wood post or wood beam.

3. The apparatus of claim 1 wherein the at least one arm has a C clamp for attaching the at least one arm to a steel beam.

4. The apparatus of claim 1 wherein the bar and the at least one arm are square tubes which are telescopically coupled to each other.

5. The apparatus of claim 4 wherein the bar and the at least one arm are adjustable from between twenty six inches to forty inches.

6. The apparatus of claim 5 wherein the bar and the at least one arm are adjustable in increments of two inches more or less.

7. The apparatus of claim 6 wherein the second horizontally extending arm is located five inches, more or less, above the first horizontally extending arm.

8. The apparatus of claim 7 wherein the first and second extension members which are telescopically coupled to the first and second connecting sleeves, respectively, have lengths for separating the J bar and the opposing J bar by a distance of between twenty eight inches and forty inches.

9. The apparatus of claim 1 wherein the at least one arm has clearance openings on all four sides to allow the at least one arm to be rotated ninety degrees and removably attached to the J bar without rotating the J bar.

10. The apparatus of claim 1 wherein the at least one arm and J bar are made of steel.

11. A method for hanging a High Voltage Air Conditioning (HVAC) unit comprising:

providing at least one arm adapted to be attached at its top end to a steel beam, wood rafter, wood joist or wood beam;

slidably coupling a bar having a first horizontally extending arm located at its bottom to form a J bar to the at least one arm;

attaching a second horizontally extending arm to the bottom of the J bar above the first horizontally extending arm;

locating clearance openings in the at least one arm and in the J bar for receiving fasteners for attaching the at least one arm to the J bar to raise or lower the first and second horizontally extending arms to provide for HVAC units of different heights;

telescopically attaching first and second coupling sleeves to the first and second vertically displaced horizontally extending arms, respectively; and telescopically attaching first and second extension members to the first and second coupling sleeves;

wherein the first and second extension members which have lengths that provide for HVAC units of different widths are adapted to be removably attached to first and second coupling sleeves on an opposing J bar;

wherein the second horizontally extending arm and extension member is provided to support an HVAC unit; and wherein the first horizontally extending arm and extension member is provided to support a drain pan.

12. The method of claim 11 wherein the at least one arm has a flat plate with clearance openings for receiving bolts or screws to attach the at least one arm to a wood rafter, wood post or wood beam.

13. The method of claim 11 wherein the at least one arm has a C clamp for attaching the at least one arm to a steel beam.

14. The method of claim 11 wherein the bar and the at least one arm are square tubes which are telescopically coupled to each other.

15. The method of claim 14 wherein the bar and the at least one arm are adjustable from between twenty six inches to forty inches.

16. The method of claim 15 wherein the bar and the at least one arm are adjustable in increments of two inches more or less.

17. The method of claim 16 wherein the second horizontally extending arm is located five inches, more or less, above the first horizontally extending arm.

18. The method of claim 17 wherein the first and second extension members which are telescopically coupled to the first and second connecting sleeves, respectively, have lengths for separating the J bar and the opposing J bar by a distance of between twenty eight inches and forty inches.

19. The method of claim 11 wherein the at least one arm has clearance openings on all four sides to allow the at least one arm to be rotated ninety degrees and removably attached to the J bar without rotating the J bar.

20. The method of claim 11 wherein the at least one arm and J bar are made of steel.

* * * * *